United States Patent [19]

Plotz et al.

[11] 3,967,032

[45] June 29, 1976

[54] BITUMINIZED ROOF SHEET

[75] Inventors: Kurt Plotz, Waldems; Klaus Breschar, Schwalbach, Taunus; Albert Klein, Frankfurt am Main, all of Germany

[73] Assignee: Hoechst Aktiengesellschaft, Frankfurt am Main, Germany

[22] Filed: Sept. 5, 1974

[21] Appl. No.: 503,331

[30] Foreign Application Priority Data

Sept. 8, 1973 Germany ..... 2345484

[52] U.S. Cl. ..... 428/300; 52/309; 52/747; 156/71; 156/154; 156/242; 156/337; 428/301; 428/474; 428/489; 428/522

[51] Int. Cl.[2] ..... E04D 5/02; E04D 5/06; B32B 27/02

[58] Field of Search ..... 156/154, 242, 337, 71; 161/236, 231, 247, 256, 227, 155, 156, 170; 117/32; 428/301, 302, 300, 489, 361, 474, 500, 522; 52/309, 747

[56] References Cited

UNITED STATES PATENTS

| | | | |
|---|---|---|---|
| 2,159,586 | 5/1939 | Greider et al. | 117/32 |
| 2,771,387 | 11/1956 | Kleist et al. | 428/489 X |
| 2,972,558 | 2/1961 | Bramble | 161/236 X |
| 3,361,609 | 1/1968 | Borack et al. | 156/242 X |
| 3,511,729 | 5/1970 | Williams | 156/242 X |
| 3,547,674 | 12/1970 | Draper et al. | 117/32 |
| 3,650,879 | 3/1972 | Munting | 161/236 X |
| 3,712,832 | 1/1973 | Stapleford | 156/337 X |
| 3,753,938 | 8/1973 | Edwards et al. | 161/236 X |

FOREIGN PATENTS OR APPLICATIONS

| | | |
|---|---|---|
| 1,250,200 | 10/1971 | United Kingdom |

*Primary Examiner*—Harold Ansher
*Attorney, Agent, or Firm*—Curtis, Morris & Safford

[57] ABSTRACT

A bituminized roof sheet has particular dimensional stability and strength when containing a spun fleece of polyester filaments reinforced in a quite special manner as carrier. The roof sheet has the following properties:

a. a tensile strength of from about 30 to 100 kp/5 cm,
b. an elongation at break of from about 20 to 60 %,
c. an elastic strain of from about 1 to 5 %,
d. a tear propagating strength of from about 2 to 8 kp,
e. a nail plucking resistance of from about 13 to 30 kp, and
f. a flexural strength of more than 5000 cycles.

7 Claims, 1 Drawing Figure

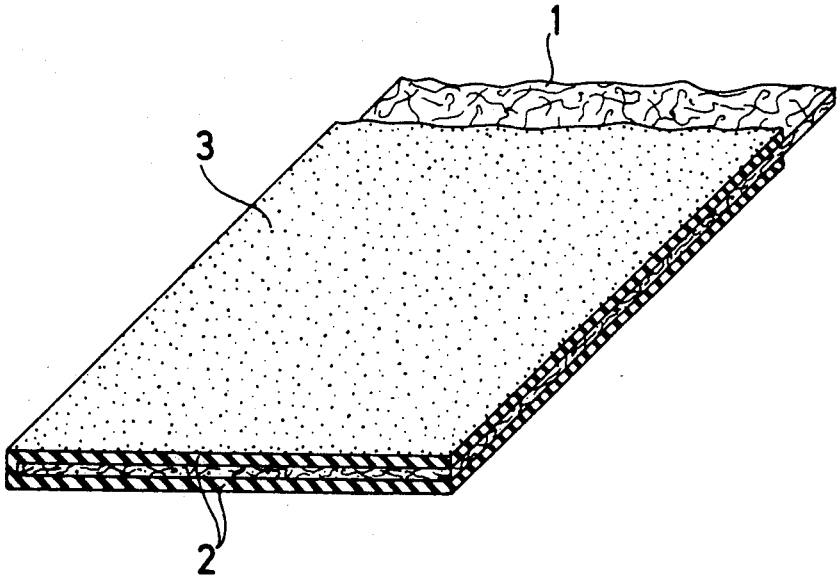
1
3
2

BITUMINIZED ROOF SHEET

Known roof sheets contain various reinforcing materials in order to ensure strength and dimensional stability. The felted paper pulp sheets of natural origin usually employed as reinforcements have a strong tendency to absorb water, which, after a certain time, results in the formation of bubbles that damage or may even destroy the roof sheet. Glass fiber fleeces have a disadvantageously low elongation at break, tear propagating strength and nail plucking resistance.

For higher stress, especially for higher tensile stress, glass grid fleeces, glass fabrics or fabrics made from synthetic materials such as polyester filaments of high strength are used. An effort has also been made to employ staple fiber fleeces, multifilament fleeces or spun fleeces (that is, filaments drawn through injector jets and deposited individually below these jets to form a spun fleece which is free from any preparation agent, as distinguished from the usual multi-filament fleeces) made from synthetic polymers for these roof sheets. The dimensional stability of these roof sheets, however, is either that of the fiber material used or depends on the kind of reinforcement chosen.

In the case of staple fiber fleeces, the advantages, for example the increased elongation at break as compared to glass fiber fleeces, are not proportional to the expenditure.

Fleece-like layers of multifilaments chemically reinforced by binder dispersions need an adhesion-improving treatment before bituminizing and sanding because of the presence on the multi-filaments of a processing agent required in their manufacture. For the impregnation of multifilaments carrying a processing agent and being loosely arranged in the form of a fleece, several process steps are required (spraying, drying, calibrating, calendering and impregnating), which adversely affects the profitability of using multifilament fleeces as carrier material for roof sheets. Moreover, when the contact points of the matted filaments are bonded, the necessary dimensional stability is not attained i.e. shrinkage in width at elevated longitudinal stress occurs.

In order to improve the properties of spun fleeces, an effort has been made to seal them thermally (German Offenlegungsschrift No. 1,945,923). In these cases, thermoplastics are generally used as fleece materials. Thermoplastics having a low melting point such as polyolefins, however, are not suitable for the manufacture of bituminized roof sheets, since the elevated temperatures generally required for the bituminization partially cause a considerable decrease of the strength obtained by heat sealing. Also thermally sealed fleeces made from thermoplastics having a high melting point do not always withstand the usual bituminization temperatures to a sufficient extent.

Shrinkage in width at high longitudinal stress during the bituminization operations may also occur when spun fleeces strengthened by needle punching are used.

The relatively inexpensive process of strengthening fleeces by needle punching is possible when the filaments are deposited as monofilaments, and it cannot be carried out with the same success when multifilaments are deposited and matted to form a fleece-like structure. The tensile strength of spun fleeces strengthened by needle punching is excellent, but because of the spaced point reinforcement by the needle punching, which is also the case when fleeces thermally bonded at the crossing points of the filaments are used, a considerable shrinking in width at high longitudinal stress cannot be prevented.

Also a dimensional stabilization of spun fleeces by means of water glass (German Offenlegungsschrift No. 2,153,659) does not result in a strength capable of withstanding the high degree of stress occurring during the manufacture of the roof sheets.

Shrinkage in width during the bituminization of spun fleeces cannot be avoided completely even in the case where these fleeces are provided with a reinforcement of the crossing points of the filaments obtained by chemical binders. The same is true in the case where the binder used for multifilament fleeces as described in German Auslegeschrift No. 1,619,056 is applied to spun fleeces.

The binder dispersions described in the cited patent have a solids content of from 10 to 60 weight %. The solid comprises a copolymer of from 45 to 55 weight % of an acrylic or methacrylic acid ester, from 24 to 30 weight % of acrylonitrile, from 12.5 to 30 weight % of styrene and from 0.5 to 2.5 weight % of acrylic acid amide, which copolymer can be prepared in known manner by emulsion polymerization in the presence of anion active and/or nonionic emulsifiers and activators. Other known auxiliaries and, optionally, a small amount of usual aminoplastic condensates may be added. The binders of this case, as is described in the examples of the cited German Patent, contain acidic components similar to the impregnated products according to German Offenlegungsschrift No. 1,938,060. However, such acidic binders, as mechanical or thermal fleece reinforcement, do not ensure a strength withstanding extremely high stress. None of the cited fleece reinforcement methods is able to prevent a certain shrinkage in width of the fleece in question to a satisfactory and sufficient extent during the bituminization.

It is therefore an object of the present invention to reinforce a spun fleece of polyester monofilaments in such a manner that there is none or only insignificant shrinkage in width during the bituminization and that, after the bituminization, a roof sheet having a number of special properties is obtained which properties, in a similar combination, are not provided by hitherto known bituminized roof sheets containing the carriers known in the art as cited above.

In accordance with the present invention, there is provided a bituminized roof sheet obtained by the use of a spun fleece carrier made of polyester and reinforced in accordance with this invention, which has the following properties:

a. a tensile strength of from about 30 to 100 kp/5 cm,
b. an elongation at break of from about 20 to 60%,
c. an elastic strain of from about 1 to 5%,
d. a tear propagating strength of from about 2 to 8 kp,
e. a nail plucking resistance of from about 13 to 30 kp, and
f. a flexural strength of more than 5,000 cycles.

As carrier material, a spun fleece made of polyester and consisting of monofilaments having a melting point of more than 250°C is preferably used. Polyethylene terephthalate is the preferred polyester. The filaments should have an individual titer of from about 3 to 15 dtex. In the spun fleece preliminarily strengthened by needle punching in known manner, the filaments are fixed by means of an aqueous binder dispersion of the kind described in German Auslegeschrift No. 1,619,056, which, however, is adjusted from neutral to weakly alkaline. This adjustment of the binder dispersion known from the above patent brings about an increased strength of the corresponding fleece as compared to the acidic adjustment. The aqueous, neutral to weakly alkaline binder dispersion has a content of from 10 to 60 weight % of solids containing a copolymer of from 45 to 55 weight % of an acrylic or methacrylic acid ester of monohydric alcohols having up to 8 carbon atoms, from 24 to 30 weight % of acrylonitrile, from 12.5 to 30 weight % of styrene, and from 0.5 to 2.5 weight % of acrylamide.

The copolymer is prepared by emulsion polymerization in the presence of anion active and/or nonionic emulsifiers and activators, as described in detail in German Auslegeschrift No. 1,619,056 and its counterpart British Specification No. 1,250,200.

A further substantial component for the fleece reinforcement in accordance with this invention is a melamine-formaldehyde precondensate added in an amount of from 10 to 30 weight %, relative to the solids content of the binder dispersion.

The spun fleece of polyester is impregnated with the above binder dispersion and the melamine-formaldehyde precondensate, thus becoming reinforced in such a manner that there are webs of the bonding polymer between the filaments. Depending on the consistency of the binder dispersion and the melamine-formaldehyde precondensate, these webs of filament-bonding polymer are obtained by impregnation or printing of the fleece.

The weight per unit area of the fleece so reinforced should be of from about 80 to 300 g/m$^2$, the strength from 20 to 100 kp/5 cm, the elongation at break from about 25 to 50% and the tear propagating strength from about 4 to 9 kp.

When polyester filaments having an individual titer of from about 3 to 15 dtex, as well as the indicated reinforcing agents, are used, the above fleece data are obtained nearly automatically, if only the weight per unit area is adjusted within the indicated range, which any expert is able to do in his normal job. When fleeces having a weight per unit area in the upper part of the indicated range are used, it is especially advantageous in order to ensure a better calendering operation to employ fleeces of fine titer filaments, that is, those having an individual titer of from about 3 to 5 dtex. The bituminized roof sheet of the present invention is obtained by calendering the spun fleeces made from synthetic polyester filaments and reinforced as described above to provide the absorbability for bitumen that is usual for roof sheets, and subsequently bituminizing and sanding them.

Tensile strength, elongation at break and elastic strain of the roof sheet in accordance with the present invention are determined in the usual manner, which need not be explained in detail. The tear propagating strength is determined according to German Industrial Standard DIN 53 859, and the nail plucking resistance is measured as follows: Two nails having a length of 6 cm are pushed through a test specimen in the form of a strip having a length of 15 cm and a width of 5 cm, each nail beng inserted at a distance of 5 cm from one end of the strip in such a manner that half of each nail protrudes from each surface of the test specimen. A metal tape having ears is slid from both sides onto each nail, and the ends of the metal tapes are screwed into the clamps of a tearing device. Thus, the test specimen is situated at low tension between the clamps of the test apparatus without touching them. Subsequently, the test apparatus expands outwardly at a speed of 5 cm/min and thus pulls the nails through the sample which itself does not move. The force necessary for moving the nails is indicated as nail plucking resistance.

The flexural strength is determined by means of the test apparatus of Messrs. Schopper. In this test, a sample having a width of 30 mm being under a preliminary tension of 1 kp is moved to and fro at the place of clamping at 120 phases/min and an angle of 2 × 90°, until the hydrophobic carrier material breaks.

The bituminized roof sheet of the invention, because of the polyester filament carrier fleece reinforced in a special manner, has excellent properties of nail plucking resistance, tear propagating strength and elongation at break.

The present invention will be better understood by reference to the accompanying drawing, which shows a sectional view of the bituminized roof sheet.

The matted fleece layer 1 is surrounded on both sides by a bitumen layer 2 the surface of which is covered with a usual layer of sand 3.

The following examples illustrate the invention.

EXAMPLE 1

A spun fleece of polyethylene terephthalate filaments (individual titer = 8 dtex) preliminarily needle punched with 40 stitches/cm$^2$ and having a weight of 100 g/m$^2$ is calendered to the desired thickness in order to reduce the bitumen absorption, and impregnated on a pad with a liquor having the following composition:

300 g of an aqueous binder dispersion adjusted to neutral, having a solids content of 50 weight % consisting of a copolymer of 52% of butyl acrylate, 25% of acrylonitrile, 21% of styrene and 2% of acrylic acid amide, 30 g of an 80% solution of trimethylolmelamine-trimethyl ether 670 g of water.

The fleece is squeezed in such a manner that a binder deposit of 12% by weight is obtained. After drying, the fleece has the following technological data, which are compared to those of a commercial glass fleece having a weight of 60 g/m$^2$:

| Technol. data | | polyethylene terephthalate filament fleece | Glass fleece |
|---|---|---|---|
| weight per unit area (g/m$^2$) | | 112 | 60 |
| strength (kp/5 cm) | longitudinal | 36.8 | 25.5 |
| | transverse | 24.3 | 21.0 |
| elongation at break (%) | longitudinal | 24.4 | 1.3 |
| | transverse | 35.3 | 1.5 |
| Tear propagating strength (kp) | longitudinal | 5.8 | 0.19 |
| | transverse | 6.2 | 0.22 |

| Data of the roof sheets obtained from these fleeces by bituminization and sanding | | roof sheet having a polyethylene terephthalate filament fleece carrier | roof sheet having a glass fleece carrier |
|---|---|---|---|
| tensile strength (kp/5 cm) | longitudinal | 50.0 | 41.5 |
| | transverse | 39.5 | 29.8 |
| elongation at break (%) | longitudinal | 36.6 | 2.9 |
| | transverse | 48.0 | 2.3 |
| tear propagating strength (kp) | longitudinal | 3.0 | 0.62 |
| | transverse | 3.0 | 1.26 |
| nail plucking | longitudinal | 17.3 | 3.7 |

-continued

| | | | |
|---|---|---|---|
| resistance (kp) | transverse | 14.6 | 6.4 |
| flexural strength (cycles) | longitudinal | 5000 | 83 |
| | transverse | 5000 | 51 |

EXAMPLE 2

Using the same material as described in Example 1 and the same binder liquor, the squeeze-off effect is adjusted in such a manner that the binder deposit is 15%, relative to the starting weight of the fleece. The subsequently dried fleece material has the following technological data:

| | | |
|---|---|---|
| strength (kp/5 cm): | longitudinal | 39.2 |
| | transverse | 24.5 |
| elongation at break (%): | longitudinal | 25.9 |
| | transverse | 39.2 |
| tear propagating strength (kp) | longitudinal | 9.1 |
| | transverse | 8.4 |

EXAMPLE 3

A spun fleece of polyethylene terephthalate of the kind as described in Example 1 is impregnated with the same amounts of binder dispersion, melamine-formaldehyde precondensate and water as indicated in Example 1, the composition of the binder solid being however as follows:

48% butyl acrylate,
25% acrylonitrile,
25% styrene,
2% acrylic acid amide

Instead of the trimethylolmelamine-trimethyl ether of Example 1, hexamethylolmelamine-trimethyl ether is used in this case. The fleece dried as indicated in Examples 1 and 2 has a binder deposit of 12% and shows the following technological data:

| | | |
|---|---|---|
| strength (kp/5 cm): | longitudinal | 35.8 |
| | transverse | 24.0 |
| elongation at break (%): | longitudinal | 27.3 |
| | transverse | 40.5 |
| tear propagating strength (kp) | longitudinal | 5.2 |
| | transverse | 5.8 |

The fleece is subsequently calendered, bituminized and sanded.

EXAMPLE 4

A spun fleece of polyethylene terephthalate filament, preliminarily needle punched with 40 stitches/cm$^2$ and having a weight of 200 g/m$^2$ (individual titer = 4 dtex) is calendered to the desired thickness in order to reduce the absorption of bitumen in the interior of the fleece and to decrease the protrusion of filament loops on the surface of the fleece, and impregnated with a liquor having the composition as indicated in Example 1. The fleece is squeezed in such a manner that a deposit of 12 weight % is obtained, dried and subsequently bituminized. The technological data of the (calendered, impregnated and dried) fleece and those of the corresponding bituminized roof sheet are the following:

| | | fleece | roof sheet |
|---|---|---|---|
| weight per unit area (g/m$^2$) | | 224 | 2100 |
| tensile strength (kp/5 cm) | longitudinal | 85.4 | 85 |
| | transverse | 63.8 | 71 |
| elongation at break (%) | longitudinal | 33.7 | 39.8 |
| | transverse | 41.3 | 47.7 |
| tear propagating strength (kp) | longitudinal | 3.8 | 6.7 |
| | transverse | 4.6 | 5.7 |
| nail plucking resistance (kp) | longitudinal | — | 25.6 |
| | transverse | — | 23.7 |
| repeated flexural strength (cycles) | longitudinal | — | >5000 |
| | transverse | — | >5000 |

What is claimed is:

1. In a bituminized roofing material comprising a sheet of bitumen reinforced with a spun fleece of synthetic polyester filaments, said filaments having a filament bonding coating thereon, the improvement which comprises a filament bonding coating consisting essentially of a copolymer of 45 to 55 weight percent of an acrylic or methacrylic acid ester of a monohydric alcohol having from 1 to 8 carbon atoms, from 24 to 30 weight percent of acrylonitrile from 12.5 to 30 weight percent of styrene and from 0.5 to 2.5 weight percent of acrylic acid amide.

2. In a bituminized roofing material comprising a sheet of bitumen reinforced with a spun fleece of synthetic polyester filaments, said filaments having a filament bonding coating thereon, the improvement which comprises a filament bonding coating consisting essentially of a copolymer of 45 to 55 weight percent of an acrylic or methacrylic acid ester of a monohydric alcohol having from 1 to 8 carbon atoms, from 24 to 30 weight percent of acrylonitrile, from 12.5 to 30 weight percent of styrene and from 0.5 to 2.5 weight percent of acrylic acid amide, said roofing material having a. a tensile strength of from 30 to 100 kp/5 cm,
b. an elongation at break of from about 20 to 60%,
c. an elastic strain of from about 1 to 5%,
d. a tear propagating strength of from about 2 to 8 kp
e. a nail plucking resistance of from about 13 to 30 kp, and
f. a flexural strength of more than 5,000 cycles.

3. A roofing material according to claim 2 wherein said polyester is polyethylene terephthalate.

4. The method of making a bituminized roofing material which comprises forming a spun fleece of synthetic polyester filaments, impregnating said fleece with a neutral to weakly alkaline aqueous dispersion of a copolymer of 45 to 55 weight percent of an acrylic or methacrylic acid ester of monohydric alcohol having from 1 to 8 carbon atoms, from 24 to 30 weight percent of acrylonitrile, from 12.5 to 30 weight percent of styrene and from 0.5 to 2.5 weight percent of acrylic acid amide, drying said fleece to cause said copolymer to bond the filaments of said fleece, calendering said fleece and thereafter bituminizing and sanding the impregnated and calendered fleece.

5. A method according to claim 4 wherein said synthetic polyester is polyethylene terephthalate.

6. A method according to claim 4 wherein said dispersion contains from 10 to 60% by weight of said copolymer.

7. A method according to claim 4 wherein said dispersion contains from 10 to 30% by weight, relative to the solid content of said dispersion, of a melamine-formaldehyde pre-condensate.

* * * * *